United States Patent [19]

Kopp

[11] 4,201,538

[45] May 6, 1980

[54] LARGE BURNERS, PARTICULARLY FOR LIQUID FUELS

[75] Inventor: Hermann Kopp, Schwendi, Fed. Rep. of Germany

[73] Assignee: Max Weishaupt GmbH, Schwendi, Fed. Rep. of Germany

[21] Appl. No.: 863,180

[22] Filed: Dec. 22, 1977

[30] Foreign Application Priority Data

Dec. 27, 1976 [DE] Fed. Rep. of Germany ..... 2659089

[51] Int. Cl.[2] ..... F23D 15/00

[52] U.S. Cl. ..... 431/351; 239/403; 239/405; 239/406; 431/182; 431/183; 431/184

[58] Field of Search ..... 431/351, 184, 183, 182; 239/399, 403, 405, 406

[56] References Cited

U.S. PATENT DOCUMENTS

| | | | |
|---|---|---|---|
| 2,242,787 | 5/1941 | Lieberherr | 431/184 |
| 3,644,077 | 2/1972 | Dimick | 431/351 |
| 3,923,251 | 12/1975 | Flournox | 431/351 |
| 3,939,073 | 2/1976 | Bats | 239/399 |
| 4,128,389 | 12/1978 | Straitz | 431/351 |

*Primary Examiner*—Samuel Scott
*Assistant Examiner*—Wesley S. Ratliff, Jr.
*Attorney, Agent, or Firm*—Max Fogiel

[57] ABSTRACT

A burner for liquid fuels such as light, medium and heavy oil, in which a fuel supply pipe is concentrically located in an air supply pipe and partially enclosed by a sleeve carrying air. A spray diffuser and a twist-producing member encloses the fuel supply pipe upstream of the spray diffuser. The twist-producing member has a fixed blower wheel and receives combustion air from the periphery thereof. The combustion air quantity is regulatable upstream of the burner head as a function of the prevailing fuel flow. A space located between the twist-producing member and the air supply pipe, holds two additional air supply pipes. One of these additional air supply pipes, an innermost pipe, has an end cone directed towards the outside. Coaxially downstream from the twist-producing member enclosing the fuel supply pipe, there are two additional twist-producing members with opposite twist direction enclosing each other. One of these additional twist-producing members is an inner member having a twist direction corresponding to the twist direction of the first-mentioned twist-producing member. The smallest diameter of the inner twist-producing member is connected to an axial discharge opening of the main or first-mentioned twist-producing member enclosing the fuel supply pipe. The largest diameter of the outer twist-producing member is located between a cylindrical part of the inside air supply pipe and its outward directed end cone. A sliding link closes, at partial load of the burner, the intake to the other twist-producing member which is the main member enclosing the fuel supply pipe, the space between the two additional air supply pipes, and the intake to the outer twist producing member, whereas the sliding link opens these elements in other load regions of the burner.

8 Claims, 5 Drawing Figures

LARGE BURNERS, PARTICULARLY FOR LIQUID FUELS

BACKGROUND OF THE INVENTION

The present invention relates to a large burner, particularly for liquid fuels (light, medium and heavy oils), with a fuel supply pipe, concentrically located in an air supply pipe and partially enclosed by a sleeve carrying air, with atomizer jet (spray diffuser) and a swirl (twist) producing body enclosing the fuel supply pipe upstream of the spray diffuser; the swirl producing body comprises a fixed blower wheel and receives combustion air from the periphery, with the combustion air quantity regulatable upstream of the burner head as a function of the prevailing fuel flow. Burners of this type are known from British Pat. No. 945,880 and German Laid-Open Document No. 1,501,904.

The spray diffusers of such large burners have the form of control jets (nozzles). Upstream of the discharge of these control nozzles is a turbulence chamber to which the oil is supplied tangentially. In the direction of the spray diffuser axis is a bore (drill hole) which serves to return the fuel not needed with partial load. As a result, the relatively small fuel quantity flowing out during partial load operation flows out at a relatively large angle, e.g., 100°–120° and forms a solid mist whose droplets are relatively small. The fuel quantity is under a relatively large pressure, e.g. of 30 bars. During partial load operation, the major part of the fuel quantity delivered to the turbulence chamber is returned (fed back) under a relatively low pressure, e.g., of 6 bars so that the fuel quantity remaining in the turbulence chamber circulates in it at a relatively high swirl (twist) speed so that this relatively large diffuser angle results. Since the fuel droplets are relatively small, they relatively quickly assume the speed of the combustion air so that they participate in this rotating motion of the air if the combustion air is supplied with twist (swirl). Due to this twisted air, an underpressure region forms in the spray diffuser area, leading to a return flow of the gases in the direction toward the oil mist so that its speed is braked. This oil mist is moved outside which, during its combustion, leads to coke deposits on the mixer device surfaces enclosing the spray diffuser. Therefore, previous metal surfaces (British Pat. No. 945,880) were replaced by a muffle (flame tube) (German Laid-Open Document No. 1,501,904) which comes to glow during burner operation in order to burn the coke deposit formed.

If one switches from partial load to full load operation, the major portion of the fuel quantity supplied to the turbulence chamber (for heavy oil), or the entire fuel quantity is sprayed via the spray diffuser of relatively small cross-section into the combustion chamber, requiring a relatively high static pressure in the turbulence chamber. Since in this case there results a relatively small difference between the pressure ahead of and the pressure in the turbulence chamber, the circulating speed of the oil in the turbulence chamber is much smaller than when operating on partial load. Accordingly, there results a smaller diffusion angle and the size of the fuel droplets increases. This increases the dwell time, necessary for complete combustion of the fuel particles, in the combustion chamber, requiring relatively large combustion chambers.

From the above it follows that the above-mentioned large burners work perfectly in full-load operation because the required dwell time is sufficient, while in partial load operation the returning gases carrying the fuel mist droplets to the forward surface of the mixing device and cause there coke deposits.

It is, therefore, an object of the present invention to generate a flow directed against the emitted oil mist, this flow being proportional to the nozzle output (droplet size), to brake the oil droplets as far as necessary, and to increase their dwell time in the combustion chamber so that complete combustion is achieved.

Another object of the present invention is to provide an arrangement of the foregoing character which is substantially simple in construction and may be economically fabricated.

A further object of the present invention is to provide an arrangement, as described, which may be readily maintained in service and which has a substantially long operating life.

SUMMARY OF THE INVENTION

The objects of the present invention are achieved by providing that starting with the large burner of the species described above, the space located between the twist (swirl) producing body and the air supply pipe holds two additional air supply pipes; the innermost pipe has an end cone directed towards the outside. Coaxially, downstream from twist-producing body enclosing the fuel supply pipe, there are two more twist-producing bodies with opposite twist direction, enclosing each other. The twist direction of the inside twist producing body corresponds to the twist direction of the twist producing body enclosing the fuel supply pipe, and the smallest diameter of the inner twist-producing body is connected to the axial discharge opening of the twist producing body enclosing the fuel supply pipe; the largest diameter of the outer twist-producing body is located between a cylindrical portion of the inside air supply pipe and its outward directed end cone. A sliding link is provided which, with partial load of the burner, closes the intake to the twist-producing body enclosing the fuel supply pipe, the space between the two other air supply pipes and the intake to the outer twist-producing body, and opens them in the other load regions. This solves the problem posed in a perfect manner; as a result, the flame produced after ignition burns stably both in the partial load area and while switching to the full-load region and in the full-load region, without contacting any surfaces of the mixing device, because when switching from partial load operation to full load operation, air can pass through the twist-producing body enclosing the fuel supply pipe and by opening the intake of the outer twist-producing body an increasing counter-twist is produced by the latter. This reduces the twist of the air flowing through the twist-producing body enclosing the fuel supply pipe, because this twist is opposed by the twist of the air conducted through the outer twist-producing body, thus preventing the hurling of fuel particles to the outside.

The sliding link (member) is provided with three closure bodies of which the one with the smallest diameter is a hollow cylinder, the next following is an annular disk and the outermost is an annular disk or a hollow truncated cone, each coaxial with the lengthwise axis of the fuel supply pipe. It is advantageous to arrange the two innermost closure bodies adjustably on the sliding link, while the outermost closure body is fixed on the sliding link. Thus, the air quantity required for partial load operation can be adjusted accurately. If this adjustment has been made, the two inside closure bodies must be located relative to the sliding link in such a way that they close both the intake to the twist-producing body enclosing the spray diffuser, and the intake to that twist-producing body whose twist direction is opposed to the former twist-producing body.

In order to influence the flame shape, for example, to enlarge the diameter of the flame, it is recommended that care be taken that the fuel supply pipe with spray diffuser and the twist-producing bodies and the inner air supply pipe and the inside closure bodies is displaced from the air supply pipes on the outside in such a way, that the outward directed end cone of the inside air supply pipe is outside the discharge opening of the air supply pipe.

The air supply pipe lying next to the air supply may be provided with a convergent end cone in order that the flame has the same diameter for partial load and for full load.

If the air supply pipe is provided with a convergent end cone, the flame diameter can be further reduced in both load regions, hence the flame becomes more slender. Such a slender flame can also be broadened if, as already mentioned above, the fuel supply pipe with the spray diffuser and the twist-producing bodies, the inner air supply pipe and the inside closure bodies is displaced relative to the outside air supply pipes. Since the sliding link with the outside closure body remains in its position, the inside closure bodies must be adjusted anew relative to the first-mentioned closure bodies.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENT

Figure 1:
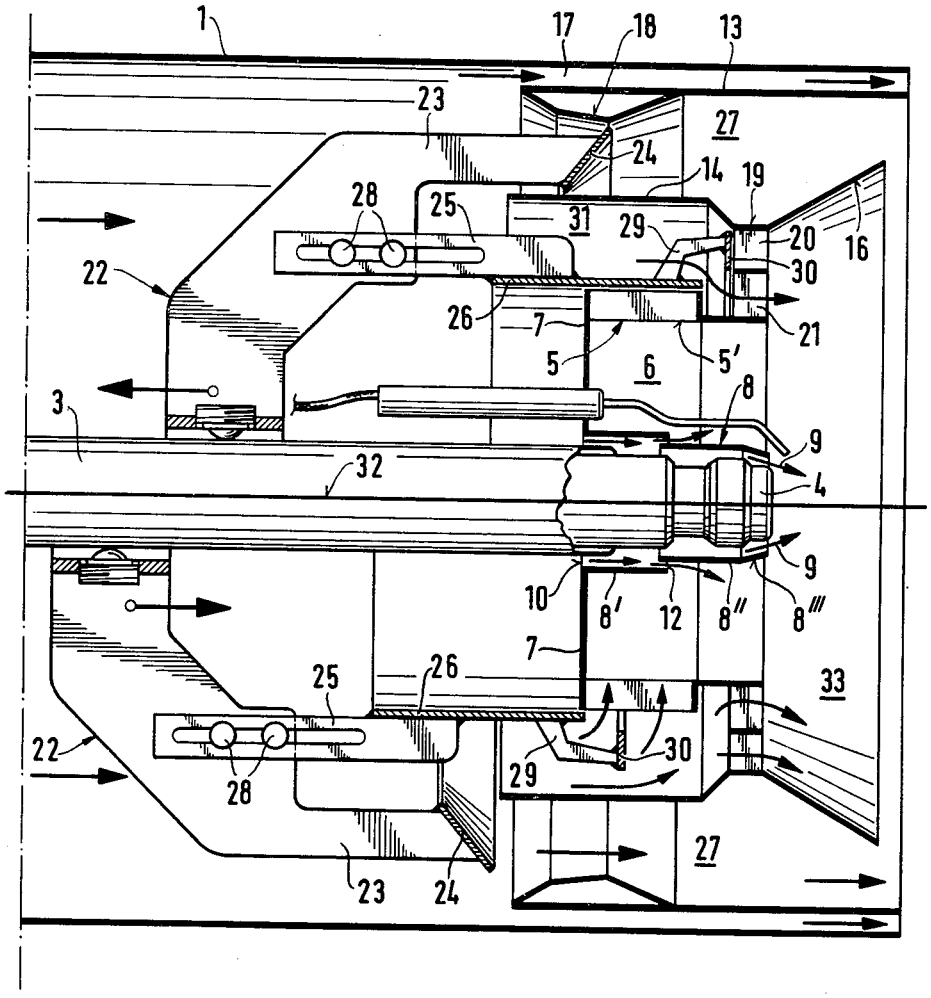
FIG. 1 shows a lengthwise section through a burner head in accordance with the invention whose miser device is located inside the air supply pipe, with parts of the burner head shown in the upper half in the position corresponding to partial load operation, while in the lower half the parts are shown in the position corresponding to full-load operation.

A fuel supply pipe 3 with spray diffuser 4, is located concentrically in a hollow cylindrical air supply pipe 1. A twist producing body 5, formed by a fixed blower wheel, encloses the fuel supply pipe 3 upstream of the spray diffuser 4 at a relatively large distance so that between the twist-producing body 5 and the fuel supply pipe, an annular space 6 is formed which is closed upstream by a wall 7. In the region of this space 6, the fuel supply pipe 3 and the spray diffuser 4 are enclosed by a sleeve 8 between which and the fuel supply pipe and the spray diffuser 4 air indicated by arrows 9 can flow. The spray diffuser 4 is surrounded by flowing air. Between the wall 7 running transversely to the fuel supply pipe 7 and the peripheral surface of the fuel supply pipe, an annular gap 10 is provided. The sleeve 8 has exit openings 12 which carry the air flow passing through annular gap 10 partially to the outside and comprises two concentric sleeve parts 8' and 8'' which makes possible simpler manufacture. The sleeve part 8'' is provided with a convergent end cone 8'''.

Between the twist-producing body 5 and the air supply pipe 1 there are two additional air supply pipes 13 and 14 of which the inside air supply pipe 14 is provided with an outward directed and hence divergent end cone 16. The outside air supply pipe 13 which forms an annular space 17 with the air supply pipe 1 has a constriction 18 on the inside comprising a sheet metal piece. The inside air supply pipe 14 also has a similar constriction 19. In the area of this constriction 19 there are two twist-producing bodies 20 and 21, enclosing each other. Of these, the smallest diameter of the inner twist-producing body 21 is connected to the axial discharge opening 5' of the twist-producing body 5, so that air carried within the inside air supply pipe 14 can pass through the two twist-producing bodies 20 and 21. Except during the so-called partial-load operation, the air carried in the air supply pipe 1, seen from the inside to the outside, flows through the annular gap 10, through twist-producing body 5, the twist producing bodies 21 and 20, between the two air supply pipes 13 and 14, and through the annular gap 17 towards the combustion chamber (not shown).

Since on the fuel air supply pipe 3, a sliding link 22 can be adjusted and on which via arms 23 a hollow truncated cone 24, (which may also be a circular disk), and via arms 25 a hollow cylinder 26 is located, the air supply to twist-producing body 5 and to the annular gap 27 can be interrupted between the air supply pipes 13 and 14. The arms 25 can be adjusted and set for simple adaptation of the hollow cylinder 26 to the twist-producing body 5 relative to the sliding link 22, as indicated by holding means 28. In addition, on hollow cylinder 26 via arms 29 there is a ring (annular) disk 30 which permits closing the outer twist-producing body 20, so that the combustion air supplied via space 31 can exit only through the twist-producing body 21 when the circular ring disk 30 closes the twist-producing body 20. In the partial load region in this case, the twist-producing body 5, the twist-producing body 20 and space 27 are closed off. Hence no combustion air flows through, which corresponds to the partial load region.

In order to show both positions of the sliding link in the drawing, the upper portion of the drawing, separated by line 32, shows the position of the parts in the partial load region and the lower portion shows the position of the parts in full-load operation or in other load regions, so that it is evident which parts of the burner are fixed and hence immovable.

Long-range tests have shown that such a burner works perfectly not only with light oil, but also with medium-weight and heavy oil and that relatively short slender flames can be produced without coke deposits and oil drops being noticed.

Figure 2:
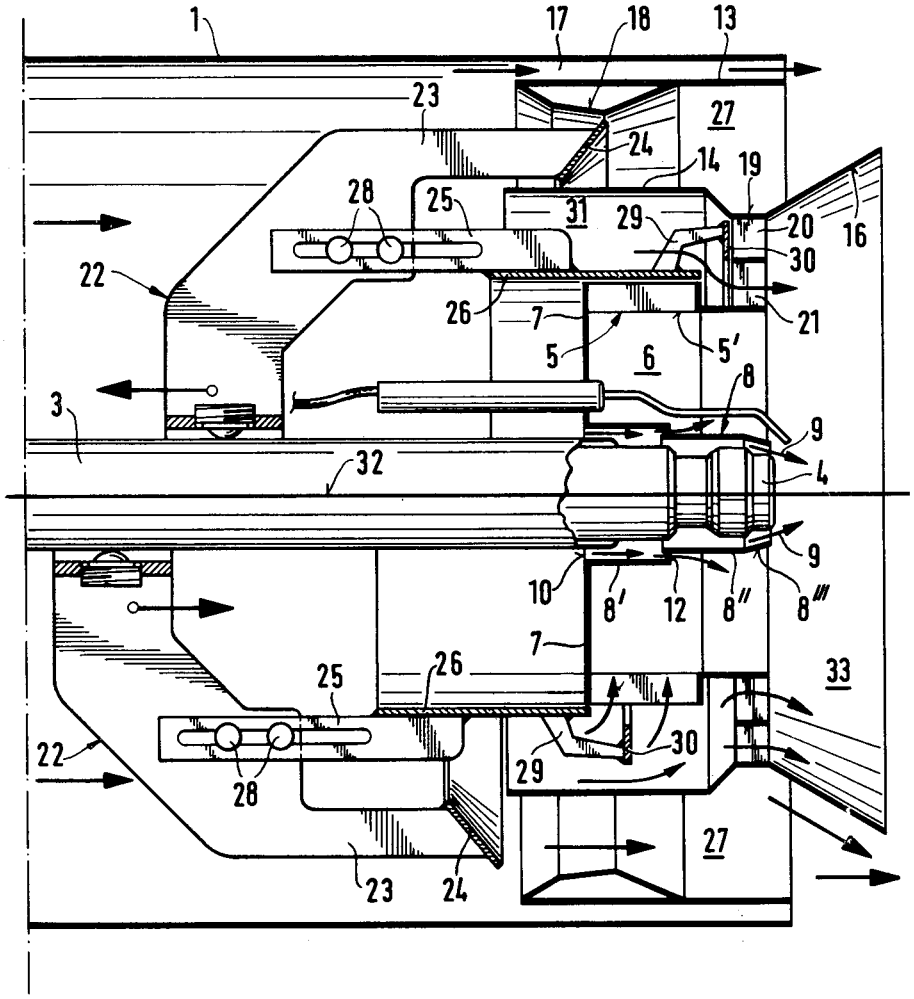
FIG. 2 shows the burner of FIG. 1, but the mixer device is displaced to the right relative to the air supply pipe.

If, as shown in FIG. 2, the fuel supply pipe 3 with spray diffuser 4, the twist-producing bodies 5, 20 and 21, the closure bodies 26 and 30 and the air supply pipe 14 with end cone is displaced from the position in FIG. 1 to that in FIG. 2, one need only take care that the closure bodies 26 and 30 close off the twist-producing bodies 5 or 20. One is able to increase the diameter of the flame if this appears useful according to the shape of the combustion chamber.

Figure 3:
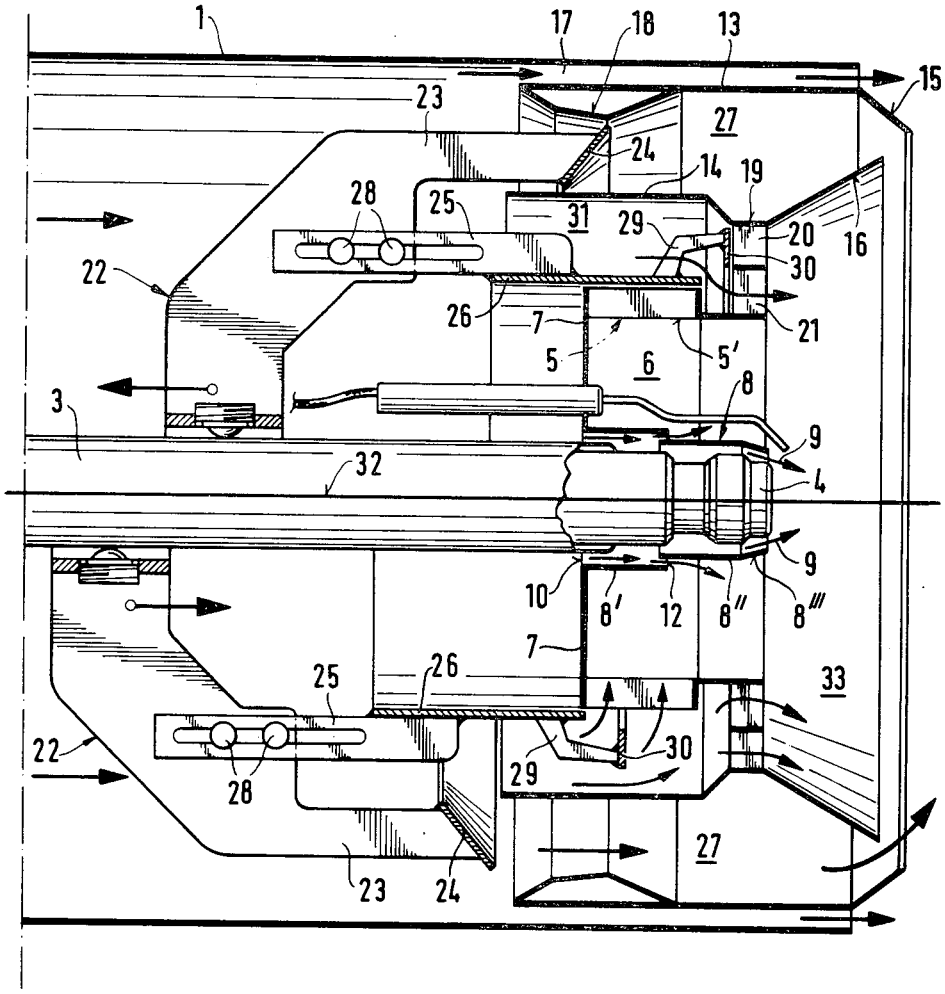
FIG. 3 shows the burner according to FIG. 1, but one of the outside air supply pipes is provided with a convergent end cone.

As shown in FIG. 3, the burner head of FIG. 1 can also be changed by assigning to the air supply pipe 13 a convergent end cone 15, so that the diameter of flame can be reduced. The diameter of the flame remains the same both with partial load and with full load.

In this case also one may provide the displacement of the inner parts of the mixer device, as explained with the embodiment of FIG. 2. Again, one obtains a widening of the flame for full load since in this case, as in the case of FIG. 2, the air flowing through the annular space 27 is directed towards the outside.

Figure 4:
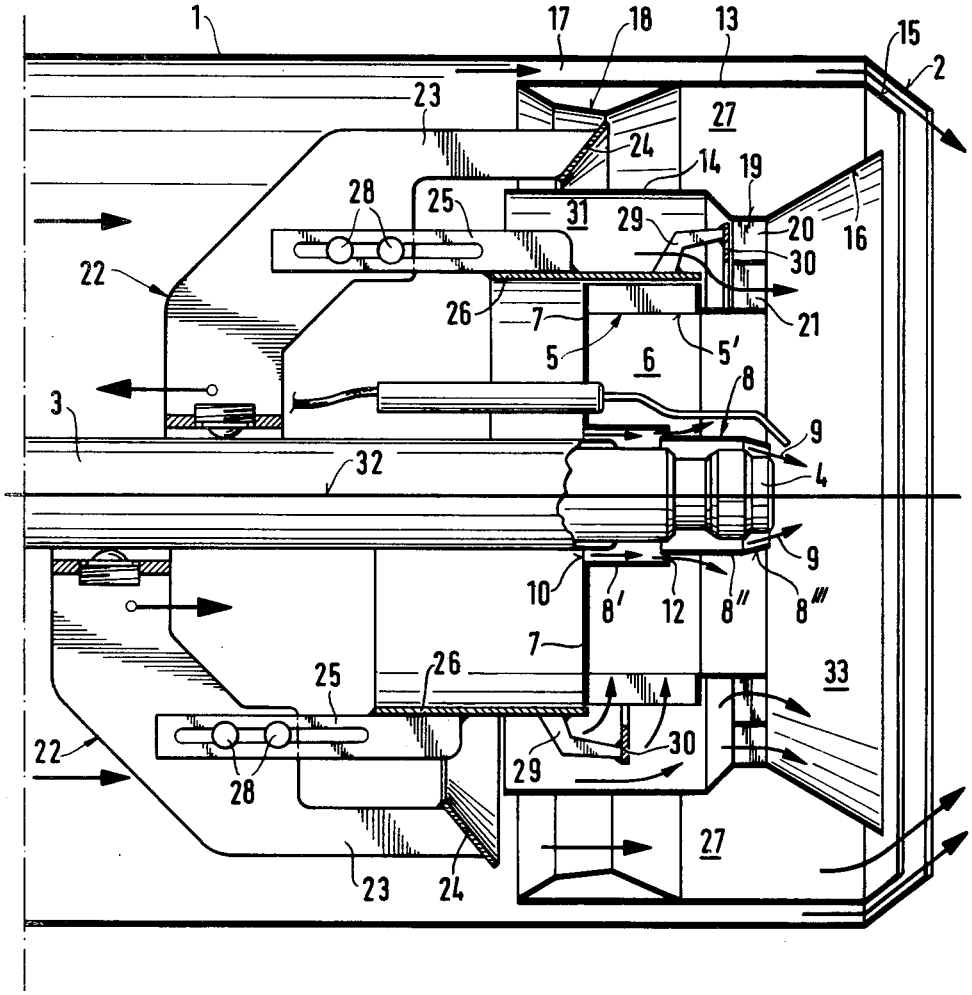
FIG. 4 shows the burner head of FIG. 1, with the actual air supply pipe being provided with a convergent end cone.

In case of the embodiment of FIG. 4 which shows a further development of the embodiment of FIG. 3, the air supply pipe 1 also is assigned a convergent end cone which makes the flame relatively short and slender with both partial load and full load.

Figure 5:
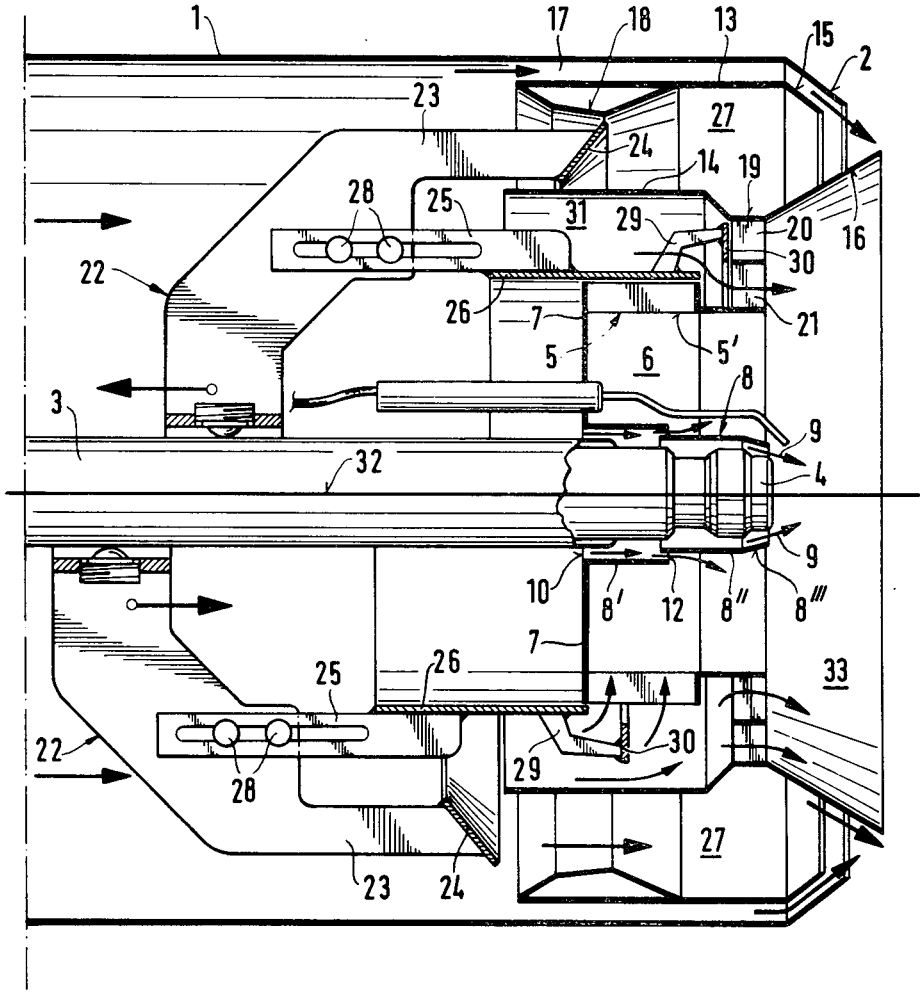
FIG. 5 shows the burner of FIG. 4, after displacing the mixer device towards the right, as already illustrated in FIG. 2.

The embodiment of FIG. 5 shows the sliding (shifting) process which has already been explained for FIGS. 2 and 3. Here the flame can be made wider than with the case of FIG. 4.

Even though the burner is particularly well suited for the combustion of liquid fuels, experiments have shown that with such a burner also gaseous fuels are combustible. In the experimental case, gas supply lines were placed so that their ends pass through the divergent end cone 16, and hence the discharges of these gas supply lines were directed into space 33 which is enclosed by this end cone.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

I claim:

1. A burner for liquid fuels such as light, medium and heavy oil, comprising: an air supply pipe; a sleeve carrying air; a fuel supply pipe concentrically located in said air supply pipe and partially enclosed by said sleeve carrying air; spray diffuser means and a twist-producing member enclosing said fuel supply pipe upstream of said spray diffuser means; said twist-producing member comprising a fixed blower wheel and receiving combustion air from the periphery thereof, the combustion air quantity being regulatable upstream of the burner head as a function of the prevailing fuel flow; two auxiliary air supply pipes in a space between said twist-producing member and said air supply pipe; said auxiliary air supply pipes having an innermost pipe with an end cone directed towards the outside; two auxiliary twist-producing members with opposite twist direction enclosing each other and located coaxialy downstream from said first-mentioned twist-producing member enclosing the fuel supply pipe; one of said auxiliary twist-producing members being an inner member with twist direction corresponding to the twist direction of said first-mentioned twist-producing member enclosing the fuel supply pipe; said inner twist-producing member having a smallest diameter connected to an axial discharge opening of said first-mentioned twist-producing member enclosing the fuel supply pipe; the other one of said auxiliary twist-producing members being an outer member with largest diameter located between a cylindrical part of the inside air supply pipe and its outward directed end cone; and a sliding link for closing at partial load of the burner the intake to said first-mentioned outer twist-producing member enclosing the fuel supply pipe, space between said two auxiliary air supply pipes, and the intake to the outer one of said auxiliary twist-producing members; said sliding link opening at other load regions of the burner, said intake to said first mentioned twist-producing member, space between said two auxiliary air supply pipes and intake to the outer one of said auxiliary twist-producing members.

2. A burner as defined in claim 1 wherein said sliding link has three closure elements, one of said closure elements having a smallest diameter and being a hollow cylinder, a second one of said closure elements being an annular disk, and a third one of said closure elements being an outside element and comprising an annular disk, each of said closure elements being coaxial with a longitudinal axis of the fuel supply pipe.

3. A burner as defined in claim 2 wherein two of said closure elements are inside elements and are located adjustably on said sliding link.

4. A burner as defined in claim 2 wherein said fuel supply pipe with spray diffuser means, said twist-producing members and the inner air supply pipe and two inner ones of said closure elements are displaced relative to the outside auxiliary air supply pipes, so that said outward directed end cone of the inside air supply pipe is substantially outside the discharge end of the air supply pipe.

5. A burner as defined in claim 1 wherein one of said auxiliary air supply pipes is adjacent to said first-mentioned air supply pipe and has a convergent end cone.

6. A burner as defined in claim 5 wherein said first-mentioned air supply pipe has also a convergent end cone.

7. A burner as defined in claim 1, wherein said first-mentioned twist-producing member and said two auxiliary twist-producing members act at different locations across diameter of said air supply pipe.

8. A burner as defined in claim 1, wherein said sliding link has three closure elements, one of said closure elements having a smallest diameter and being a hollow cylinder, a second one of said closure elements being an annular disk, and a third one of said closure elements being an outside element and comprising an annular disk, each of said closure elements being coaxial with a longitudinal axis of the fuel supply pipe, two of said closure elements are inside elements and are located adjustably on said sliding link; said fuel supply pipe with spray diffuser means, said twist-producing members and the inner air supply pipe and two inner ones of said closure elements being displaced relative to the outside auxiliary air supply pipes, so that said outward directed end cone of the inside air supply pipe is substantially outside the discharge end of the air supply pipe; one of said auxiliary air supply pipes being adjacent to said first-mentioned air supply pipe and has a convergent end cone; said first-mentioned air supply pipe having also a convergent end cone.

* * * * *